US007105234B2

(12) United States Patent
Miska

(10) Patent No.: US 7,105,234 B2
(45) Date of Patent: Sep. 12, 2006

(54) FLAME RETARDANT CORROSIVE RESISTANT CONDUCTIVE FABRIC ARTICLE AND METHOD

(75) Inventor: Stanley R. Miska, Pittsford, NY (US)

(73) Assignee: Schlegel Systems, Inc., Rochester, NY (US)

( * ) Notice: Subject to any disclaimer, the term of this patent is extended or adjusted under 35 U.S.C. 154(b) by 772 days.

(21) Appl. No.: 09/822,113

(22) Filed: Mar. 30, 2001

(65) Prior Publication Data

US 2002/0142684 A1 Oct. 3, 2002

(51) Int. Cl.
*B32B 15/04* (2006.01)

(52) U.S. Cl. ..... 428/457; 428/458; 442/63; 442/148; 442/286

(58) Field of Classification Search ..... 428/457, 428/458, 920, 921, 932, 934, 935, 936, 937, 428/938, 36.2; 442/63, 64, 65, 66, 67, 68, 442/71, 72, 73, 74, 75, 78, 110, 117, 126, 442/131, 132, 133, 13, 148–151, 164–171, 442/180, 188, 226–233, 236, 254, 255, 261, 442/286, 378, 379, 394
See application file for complete search history.

(56) References Cited

U.S. PATENT DOCUMENTS 4,816,124 A * 3/1989 Manabe et al. ..... 204/192.14
4,857,668 A * 8/1989 Buonanno ..... 174/35 GC
4,965,296 A * 10/1990 Hastings ..... 523/179
5,597,979 A 1/1997 Courtney et al.
5,674,606 A * 10/1997 Powers, Jr. ..... 428/328
5,712,449 A * 1/1998 Miska et al. ..... 174/35 GC
6,248,393 B1 * 6/2001 Bunyan et al. ..... 427/77
6,368,682 B1 * 4/2002 Fong ..... 428/1.5
6,387,523 B1 * 5/2002 Bunyan et al. ..... 428/457
6,410,137 B1 * 6/2002 Bunyan ..... 428/356
6,465,731 B1 * 10/2002 Miska ..... 174/35 GC
6,521,348 B1 * 2/2003 Bunyan et al. ..... 428/457
6,541,698 B1 * 4/2003 Miska ..... 174/35 GC
6,716,481 B1 * 4/2004 DeAngelis et al. ..... 427/121
6,758,148 B1 * 7/2004 Torrey et al. ..... 108/51.11
6,777,095 B1 * 8/2004 Bunyan et al. ..... 428/457
2002/0129494 A1 * 9/2002 Miska ..... 29/846
2003/0036326 A1 * 2/2003 Takagi et al. ..... 442/222
2003/0124934 A1 * 7/2003 Bunyan et al. ..... 442/226
2003/0211291 A1 * 11/2003 Castiglione et al. ..... 428/172

FOREIGN PATENT DOCUMENTS

AU B-67038/90 1/1994

OTHER PUBLICATIONS

Test for Flammability of Plastic Materials for Parts in Devices and Appliances reproduced by Global Engineering Documents.

* cited by examiner

*Primary Examiner*—Arti R. Singh
(74) *Attorney, Agent, or Firm*—Stephen B. Salai; Brian B. Shaw, Esq.; Harter, Secrest & Emery LLP

(57) ABSTRACT

Disclosed is a conductive, flame-retardant polymeric fabric composed of a woven or non-woven nylon, polyester or acrylic fabric. A surface of the fabric is provided with a flame-retardant layer applied by coating the flame-retardant directly onto the fabric surface. Disposed on the flame-retardant layer is a conductive metal applied preferably by vapor deposition. The resulting article not only has a surface resistance of less than one ohm/sq, but also the article has an Underwriter Laboratories very thin material (VTM) vertical bum test rating of zero rendering the article suitable for use as an electromagnetic interference shielding fabric.

15 Claims, 1 Drawing Sheet

FLAME RETARDANT CORROSIVE RESISTANT CONDUCTIVE FABRIC ARTICLE AND METHOD

TECHNICAL FIELD

The present invention relates to flame resistant conductive fabrics and more particularly to such a fabric having utility as a component of electromagnetic interference (EMI) and radio frequency interference (RFI) shielding products.

BACKGROUND OF THE INVENTION

Many modern electronic devices require flame retardant approval from Underwriters Laboratories (UL). These include such devices as personal and business computers, various radio frequency and microwave devices, equipment used in telephone base stations and switching electronics. If each individual component of such apparatus has UL approval, the overall apparatus does not require flame-retardant approval. Thus, ensuring that each component has UL approval avoids the need for UL testing of the entire apparatus and reduces cost to the apparatus manufacturer.

The need for flame retardant approval of individual components extends to fabric materials that may be used in various shielding components of the apparatus. Shielding components protect the electrical or electronic components of the apparatus from electromagnetic interference (EMI). Electromagnetic interference is understood to mean undesired conducted or radiated electrical disturbances from an electric or electronic apparatus, including transients, which can interfere with the operation of other electrical or electronic apparatus. Such disturbances can occur anywhere in the electromagnetic spectrum. Radio frequency interference (RFI) refers to disturbances in the radio frequency portion of the electromagnetic spectrum but often is used interchangeably with electromagnetic interference. Both electromagnetic and radio frequency interference are referred to hereafter as EMI.

Electronic devices not only are sources of EMI, but also the operation of such devices may be adversely affected by the emission of EMI from other sources. Consequently, electric or electronic apparatus susceptible to electromagnetic interference generally must be shielded in order to operate properly.

Many shielding applications such as gaskets, cable shields, grounding straps, conductive tapes, laminate shields among others, utilize a conductive fabric in its construction. For example, a gasket for use between a computer cabinet and a cabinet door may comprise a resilient core enclosed in a conductive fabric. Conductive fabrics generally are formed of polymeric fibers and are either woven or non-woven. To render the fabric conductive, the fibers may include particles of a conductive material or the fabric may be coated with a conductive metal by various methods including electroless plating and vapor deposition among others.

One method of providing a conductive fabric with flame retardant properties is to incorporate a flame retardant into the material of the fabric. For example, U.S. Pat. No. 5,674,606 discloses dispersing alumina trihydrate in a polymeric material used to form a conductive fabric. A further alternative is to form the fabric of fiberglass. While a fiberglass fabric is inherently fire resistant, it is brittle and subject to cracking in dynamic applications. Substrate fabrics of polymeric materials generally are more flexible and durable than fiberglass and are preferred. The problem is that prior attempts to produce a conductive polymeric fabric having flame-retardant properties suitable for use as an EMI shield have not been entirely satisfactory.

The industry standard for a flame retardant EMI shielding fabric is a fabric having an Underwriters Laboratories rating for very thin material (VTM) of zero burn in a vertical burn test (described hereinbelow). A VTM burn rating of zero is particularly difficult to achieve for metalized polymeric fabrics because the metal coating acts as an accelerant to combustion.

Incorporating a flame retarding material into the formulation of the polymeric material of the fabric provides a degree of protection but does not completely solve the problem. Applying a flame-retardant material over the conductive metalized surface may provide a UL approved material. However, the amount of flame retardant that must be applied over the metalized surface in order to obtain the UL VTM zero burn rating (vertical burn test) forms such a thick layer that it significantly decreases the surface conductivity of the metalized fabric. Since high surface conductivity is a desirable attribute of EMI shielding material, a material having a low surface conductivity renders it unacceptable for such use. Low surface conductivity also is caused by corrosion of the conductive metal layer and conventional flame-retardant materials accelerate galvanic corrosion of the conductive metal. This is another reason why applying a flame-retardant coating to the metalized surface of a conductive fabric has not been an acceptable solution.

Accordingly, it is an object of the present invention to provide a electrically conductive polymeric fabric having flame retardant properties.

Another object of the present invention is to provide a conductive polymeric fabric that has an Underwriters Laboratories vertical burn test VTM flammability rating of zero.

A further object of the present invention is to provide a flame retardant conductive polymeric fabric that is corrosion resistant so as to maintain a high degree of surface conductivity over time.

Yet another object of the present invention is to provide method of making a flame retardant conductive polymeric fabric suitable for use in EMI applications.

SUMMARY OF THE INVENTION

In accordance with the present invention, it has been unexpectedly found that applying a fire retardant material directly to the surface of a polymeric fabric and then applying a conductive metal coating over the fire retardant, provides a fire retardant fabric without compromising high surface conductivity. The application of the fire retardant directly to the fabric surface unexpectedly provides the fabric with a greater flame-retardant property than applying the fire retardant over the surface of the metal coating. Following the teachings of the present invention, a conductive polymeric fabric having flame-retardant properties is obtained using less of the flame-retardant material and without compromising the surface conductivity.

The flame-retardant electrically conductive article of the present invention includes a substrate of a woven or non-woven fabric of a polymeric material such as a polyamide, polyester or acrylic. A flame-retardant coating first is applied directly to the surface of the fabric. Flame retardant materials are well known. These include for example melamine and neoprene. Other flame-retardant materials include a halogenated or non-halogenated flame-retardant material uniformly dispersed in a suitable carrier. For purposes of the present invention the carrier preferably is a liquid that after application to the surface of the fabric, dries, cures or polymerizes in situ to form a thin polymeric film bonded to the fabric. This allows the flame retardant to be uniformly distributed in a thin polymeric film matrix applied to the surface of the fabric by dipping, wiping or spraying.

After a thin film of the flame-retardant coating is applied, a conductive metal is laid down over the surface of the flame-retardant coating. Any suitable plating process including electroplating or electroless plating may be used to apply the metal coating. In a preferred process, the conductive metal coating is applied by vapor deposition. In one method, the conductive coating is applied in three successive layers. A first applied layer is a metal, an alloy or a nonmetal that adheres to the flame-retardant polymeric film. A second applied layer is a highly conductive metal such as silver and a third layer is a corrosion and abrasion resistant layer also of a metal, an alloy or a nonmetal. Etching the surface of the flame-retardant coating with a plasma or corona discharge may improve the adherence of the metal to the flame-retardant coating, It is believed that improved flame-retardant properties of the article result from separating the flammable polymeric fabric substrate from the conductive metal by disposing a layer of the flame-retardant between the two. By separating the metal from the flammable polymeric fabric, the fabric is insulated from the heat generated and retained by the metal when exposed to a flame. When exposed to flame or heat, the separation as described above prevents the heated metal from igniting or supporting the combustion of the fabric substrate.

This is in contrast with prior art constructions wherein the metal is disposed directly on the fabric substrate and a flame-retardant is then coated onto the metal. In this prior art construction it is believed that even though the fabric may itself contain a flame-retardant and a flame-retardant is coated over the metalized surface, the heating of the metal in direct contact with the fabric causes or promotes the combustion of the fabric.

Accordingly, the present invention may be characterized in one aspect thereof by a flame retardant metalized fabric article comprising:

a) a polymeric fabric substrate having a reverse side and an obverse side;

b) a conductive metal layer on one side of the substrate; and c) a flame-retardant coating intermediate the conductive metal layer and the polymeric fabric substrate.

In another aspect, the present invention may be characterized by a method of forming a flame-retardant conductive polymeric fabric by the steps of:

a) applying a flame-retardant coating directly onto the surface of a polymeric fabric; and b) applying a conductive metal onto the surface of the flame-retardant coating.

DETAILED DESCRIPTION OF THE INVENTION

Figure 1:
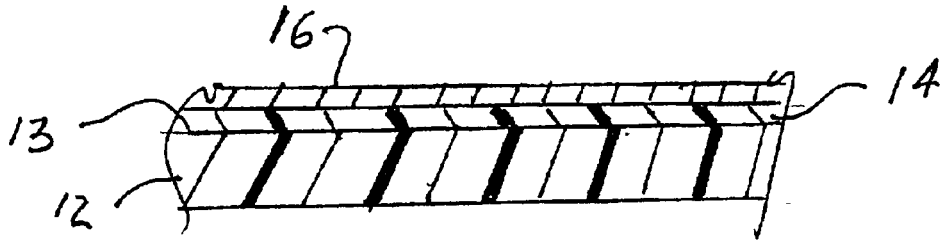
FIG. 1 is a cross sectional view showing a portion of the flame-retardant conductive fabric article of the present invention.

Referring to the drawings, FIG. 1 shows a flame-retardant conductive fabric article of the present invention generally indicated at 10. The article includes a substrate 12 of a polymeric material such as nylon, polyester or acrylic formed as a woven or non-woven fabric. Other flammable or non-flammable fabrics may also be used.

Coated onto an obverse side 13 of the fabric is a flame-retardant layer 14. A flame-retardant coating generally comprises a material that can be applied as a liquid to the surface of the fabric and forms a thin film when it is dried, cured or polymerized. Suitable flame-retardant materials include melamine and neoprene which are themselves flame-retardant. Other materials include a film-forming carrier such as polyurethane or an acrylic that incorporates any halogenated or non-halogenated flame-retardant additive including alumina trihydrate among others.

Application of the flame-retardant coating is by dipping, spraying or wiping so as to apply the carrier as a thin film over the surface of the fabric. While not shown, it should be appreciated that at least some portion of the liquid carrier may penetrate into the body of the fabric. After application, the flame-retardant is allowed to dry, cure or polymerize to form a thin polymeric film layer 14 that bonds with the polymeric fabric of the substrate. One or more applications of the flame-retardant material can be made to provide a desired film thickness.

A conductive metal layer 16 then is applied to the surface of the flame-retardant layer 14. The metal layer 16 may be applied by any suitable method such as electroless plating, electrolytic plating, by vapor deposition or by a combination of methods. Preferably the metal layer 16 is applied by vapor deposition.

Figure 2:
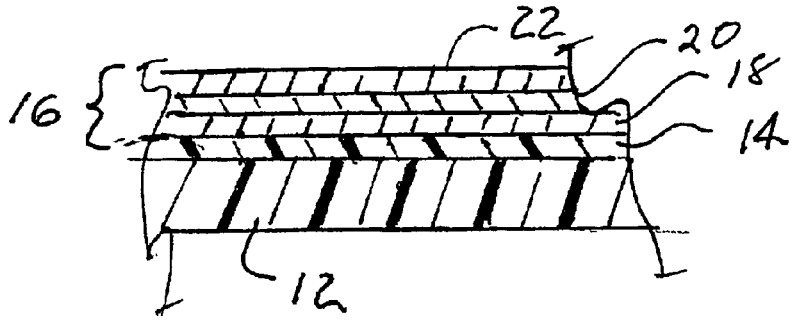
FIGS. 2–4 are views similar to FIG. 1 only showing other embodiments of the invention.

As best seen in FIG. 2, the metal layer 16 may comprise three or more layers. In this respect, if the conductive metal does not readily adhere to the polymer surface of the flame-retardant layer 14, a first layer 18 may be applied as an adherence layer. A suitable adherence layer preferably is a NICHROME® nickel-chrome alloy but can be any other metal or alloy such as chrome, an INCONEL® iron-chrome-nickel alloy or titanium among others having the property of adhering both to the flame-retardant layer 14 and to a second layer 20.

The second layer 20 is the conductive layer of the film and can be any highly conductive metal such as copper, gold, silver or platinum with silver being preferred. A third and surface layer 22 is deposited over the conductive layer for abrasion resistance and in the case of silver, to prevent oxidation of the silver layer. The surface layer may be carbon, a metal or an alloy, which adheres to the conductive metal layer 20 and is corrosion resistant.

In many applications, it is likely that the conductive surface of the fabric will contact an adjacent metal surface such as a computer housing. Accordingly, the accelerated oxidation of the conductive silver layer on the fabric by galvanic action also is a concern. Oxidation or corrosion of the conductive metal will decrease the surface conductivity of the fabric and compromise its effectiveness as an EMI shield. A surface layer 22 of a pure metal such as nickel, aluminum, iron, tin or zirconium or a metal alloy such as an iron-chrome-nickel alloy, a nickel-chrome alloy, or a carbon compound will provide protection against galvanic action and be abrasion resistant without compromising the conductivity of the surface. To reduce costs and facilitate fabrication, the layers of the metalized layer 16 may be deposited in sequence by vapor deposition.

Abrasion resistance, corrosion resistance and galvanic compatibility also are provided by a thin outer coating of an organic material such as an acrylic, polyurethane, polyester or polycarbonate among others. Even though these materials are non-conductive, a thin layer will provide the desired protection without materially decreasing the conductivity of the metal layer beneath.

Figure 3:
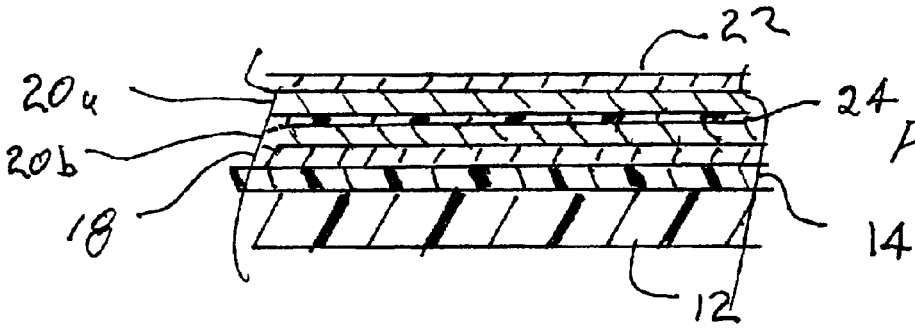

It further is possible to improve the shielding effectiveness of the film by adding any of the organic materials noted above, among others, as a thin dielectric layer between metal layers to provide capacitance coupling. This is shown in the embodiment of FIG. 3 wherein the conductive metal layer 20 includes a dielectric layer 24 disposed between adjacent silver layers 20*a* and 20*b*. The fabric itself also can function as a dielectric. In this case, as shown in FIG. 4, the opposite sides of the fabric 12 are first both coated with a flame-retardant coating 30 and then coated with conductive metal layers 32,34.

Figure 4:
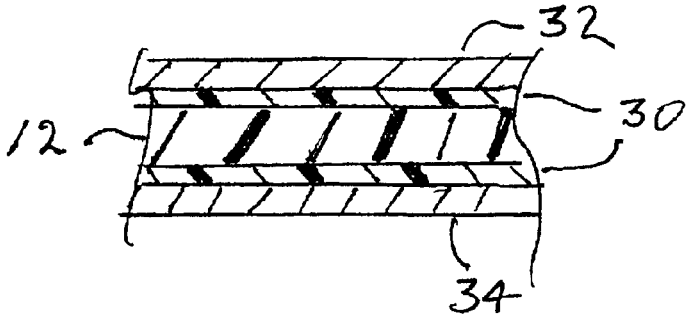

The structure of the article as shown in FIG. 4 is symmetrical in that the layers at one side of the fabric substrate mirror those on the other. A asymmetrical structure also is possible wherein one or more layers at one side of the fabric do not appear at the other side. Accordingly, it should be appreciated that the article of the present invention also may include one or more layers of a non-metal or metal at one side or the other to provide dielectric properties or to provide other desirable properties including adherence to the fabric substrate or abrasion resistance. After application of the flame retardant directly to one or both sides of the fabric substrate, any number of layers can be built up by vapor deposition provided the materials are selected so that adjacent layers adhere one to another.

Samples of coated fabrics were formed and subjected to two tests. In a corrosion test, the fabric article is mated to a dissimilar metal and the surface resistance of the article is measured over time. The articles also are subjected to a flammability test that generally follows the Underwriters Laboratories test procedure for a vertical burn of very thin materials (VTM). The UL vertical burn test is a standard test more fully described in UL publication titled "Test for Flammability of Plastic Materials for Parts in Devices and Appliances" which is incorporated herein by reference.

The UL publication may be consulted for details of the test procedure. However, for purposes of the present invention it is sufficient to say that in the Thin Material Vertical Burning Test, the test specimens are cut to a size of about 200×50 mm. The specimen is suspended so its longitudinal axis is vertical. A controlled flame is applied to the middle point of the bottom edge of the test specimen. After about three seconds, the flame is withdrawn (dropped vertically from its initial position) at a rate of about 300 mm/sec to a distance of about 150 mm away from the specimen. Simultaneously, a timing device commences the measurement of the Afterflame Time ($t_1$). "Afterflame Time" is defined as the time a material continues to flame, under specified conditions, after the ignition source has been removed.

When the specimen has stopped flaming, the burner is placed about 10 mm from the specimen for another three seconds and again withdrawn and the Afterflame Time measured a second time ($t_2$) and the Afterglow Time ($t_3$) also is measured. "Afterglow Time" is defined as the time a material continues to glow under specified test conditions after the ignition source has been removed and/or the cessation of flaming. For a rating of zero, both $t_1$ and $t_2$ must be less than ten seconds and the sum of $t_2$ and $t_3$ must be less than thirty seconds.

For purposes of the Vertical Burn Test, control samples were made using a woven rip-stop 30 denier nylon fabric having a 130×130 warp and weft yarn count. All samples ranged between about 0.10 and 0.12 mm thick.

For Sample A, the fabric first was coated with silver using an electroless plating process. The silver saturated and permeated the fabric and formed a silver layer about 3000 Å thick on at least one side of the fabric. The silver layer then was face coated with a layer about 0.5 mil thick of a flame-retardant material comprising a halogenated flame-retardant particles and carbon (for color) dispersed in a polyurethane matrix. The silver coating on the back or opposite side of the fabric also was coated with flame-retardant using a similar material to provide a 2 mil thick coating. The backside flame-retardant coating, is a similar flame retardant only lacking the carbon.

Sample B is similar to Sample A except the face coat of the flame-retardant was about one mil thick of the flame retardant.

Both Samples A and B, in effect were balanced structures in that the nylon fabric had a silver layer coating both sides and both silver layers were over coated with a flame-retardant material.

The initial surface conductivity of each sample was measured. To have an acceptable conductivity, the surface resistance of the article should be less than one ohm/sq. Both samples met this standard. The samples then were subjected to the UL VTM vertical burn test. Of the two samples, Sample A failed the burn test and was not further tested. Sample B having a one mil face coating of the flame-retardant and a 2 mil backside coating of the flame-retardant passed the burn test but failed in other respects. In particular, it was found that a sample formed as Sample B does not survive a corrosion test, which measures the increase in resistance (loss of surface conductivity) over time.

In the corrosion test, samples are subjected to galvanic action for a period of time after which the surface resistance of the sample is measured. Corrosion testing is conducted by mating the fabric with a surface formed of a dissimilar metal such as zinc, aluminum or chromate.

When a sample in accordance with Sample B is tested for corrosion resistance, its surface conductivity drastically deteriorates in a relatively short time. After a period of only ten days, the surface conductivity of the test specimens as measured by surface resistance are greater than one ohm/sq which renders them not suited for use in EMI shielding applications.

Other test specimens were prepared by first applying a coating of a flame-retardant material directly to the surface of the substrate polymeric fabric. The conductive coating then was applied over the flame-retardant layer. Thus in all the following examples, the flame-retardant was disposed between the metal layer and the substrate so as to insulate the substrate from the direct heat generated in by the metal layer.

Sample C was formed using the same woven nylon fabric as Sample A. The flame retardant was applied directly over one surface of the fabric to provide a layer having a total coating thickness of about 0.5 mil. The surface of the flame-retardant layer first was plasma etched and then a metal coating was applied over the flame-retardant layer by vapor deposition. The vapor deposition process applied a first adhesive layer of NICHROME® nickel-chrome alloy directly to the flame-retardant layer. Then a conductive layer of silver and finally an abrasion/corrosion resistant layer of NICHROME® nickel-chrome alloy were applied in sequence. The thickness of each alloy layer was about 250 Å and the thickness of the silver layer was about 3000 Å.

Sample D was similar to Sample C in all respects except the fabric was a polyester fabric.

Sample E and Sample F were similar to Samples C (nylon fabric) and D (polyester fabric) respectively except the flame-retardant was applied directly over one surface of the fabric to provide a layer about one mil thick.

All samples had a thickness of about 0.10 mm and all had an acceptable initial surface conductivity in that the surface resistance of the article was well below 0.1 ohm/sq. The Samples with a half-mil layer of flame-retardant (Samples C and D) did not survive the vertical burn test and were not further tested. Samples E and F satisfied the requirements of the UL vertical bum test in that they both had a VTM vertical bum test rating of zero (VTM-0).

The articles having a VTM vertical burn rating of zero were then tested for corrosion resistance to galvanic action. For corrosion testing, articles corresponding to Samples E–F are prepared by applying a flame-retardant coating about one mil thick directly to the surface of a polymeric rip-stock fabric. A metal coating then is applied by vapor deposition directly over the flame-retardant layer. A described above the metal is deposited in three layers comprising an adherence layer, a conductive metal and an abuse/corrosion resistant layer. These, in particular were 250 Å NICHROME® nickel-chrome alloy, 3000 Å silver and 250 Å NICHROME® nickel-chrome alloy.

For corrosion testing, the articles were mated to surfaces of dissimilar metals including aluminum, zinc and chromate and the surface resistance of each sample was periodically measured to determine the conductivity of the sample. At the start of testing, the surface resistance of all samples varied from 0.02 to 0.05 ohm/sq or less. After a fall thirty days of testing the surface resistance of all samples was again measured. All samples having an initial surface resistance of less than 0.05 ohms/sq had a surface resistance after thirty days of 0.04 ohms/sq or less. The one sample having an original surface resistance of 0.05 ohms/sq had a surface resistance of 0.08 ohms/sq after thirty days. These articles comprising a flame-retardant layer disposed between the fabric and the metal layer, having a UL VTM vertical burn rating of zero and maintaining a high surface conductivity over time are embodiments of the present invention.

Another typical metal layer configuration as an alternative to the configuration of Samples E–F can be a 100 Å thick layer of INCONEL® iron-chrome-nickel alloy, 2000 Å of silver and a 100 Å surface layer of INCONEL® iron-chrome-nickel alloy. Samples of this type having an initial surface resistance of about 0.11 ohms/sq had a surface resistance of about 0.35 ohms/sq or less.

Thus it should be appreciated that the present invention accomplishes its intended objects in providing a flame-retardant corrosion resistant conductive fabric. Isolating the polymeric fabric from the conductive metal layer by disposing a flame-retardant layer between the two provides am improved bum resistance as compared to applying the flame-retardant over the metal layer. Resistance to corrosion by galvanic action also is improved. Applying a one mil flame-retardant coating directly to the fabric (Samples E and F) is seen to provide better flame-retardant protection and corrosion resistance than application of a face coating of the same thickness over the metal layer (Sample B).

While a preferred embodiment has been described, it should be appreciated that modifications may be made without changing the spirit and scope of the invention. For example, the flame-retardant coating may be applied directly to both sides of the fabric to provide additional protection. Two-sided flame-retardant coating also used in cases where it is desired to metalize both sides of the fabric. Both sides may be metalized for example where the fabric article is used as a dielectric to provide capacitance coupling.

Having described the invention in detail, what is claimed as new is:

1. A flame retardant metalized fabric article comprising:

a) a polymer fabric substrate having a reverse side and an obverse side;

b) a conductive metal layer on one side of the substrate; and c) a flame retardant coating intermediate the conductive coating metal layer and the polymeric substrate, wherein the flame retardant comprises a film forming carrier and a halogenated or non-halogenated flame retardant additive uniformly distributed in the carrier; and d) wherein the metal layer comprises a first metal layer applied directly to said flame retardant layer, a second conductive metal layer and a third abrasion resistant surface layer.

2. An article as in claim 1 having an Underwriter Laboratories very thin material (VTM) vertical burn test rating of zero.

3. An article as in claim 1 having a surface resistance of less than one ohm/sq.

4. An article as in claim 1 wherein said flame-retardant is applied directly to only said obverse side of said polymer fabric substrate.

5. An article as in claim 1 wherein said flame-retardant comprises a layer about one mil thick.

6. An article as in claim 1 wherein said flame retardant additive is alumina trihydrate.

7. An article as in claim 1 wherein said metal layer is a vapor deposited metal layer of about 3000 Å.

8. An article as in claim 1 wherein said adhesive metal is a 100 to 250 Å thick layer selected from the group consisting of a nochel-chrome alloy, chrome, an iron-chrome-nickel alloy and titanium.

9. An article as in claim 1 wherein said conductive metal is a 2000 Å to 3000 Å thick layer of a conductive metal selected from the group consisting of copper, gold, silver and platinum.

10. An article as in claim 1 wherein said abrasion resistant surface layer is a 100 Å to 250 Å thick layer selected from the group consisting of nickel, aluminum, iron, tin or zirconium, an iron-chrome-nickel alloy, a nickel-chrome alloy and carbon.

11. An article as in claim 1 wherein said fabric is a woven or non-woven rip-stock fabric selected from the group consisting of nylon, polyester and acrylic fabrics.

12. An article as in claim 1 including a flame-retardant coating applied directly to both said reverse and obverse sides of said polymeric fabric substrate and said metal layer is on only said obverse side.

13. An article as in claim 4 wherein said flame-retardant comprises melamine or neoprene.

14. A conductive metalized flame-retardant fabric article comprising:

a) a woven or non-woven polymeric fabric;

b) a flame-retardant coating applied directly to a surface of said fabric, said coating comprising a flame-retardant material uniformly disposed in a film forming polymeric liquid wherein said liquid is applied directly to one surface of said fabric and is dried, cured or polymerized in situ to form a coating about one mil thick on said fabric surface;

c) a vapor deposited conductive metal coating applied to said flame-retardant coating; and d) said article having an Underwriter Laboratories very thin material (VTM) vertical burn test rating of zero and a surface resistance of less than one ohm/sq.

15. An article as in claim 14 wherein said conductive metal coating includes two layers of said conductive metal disposed on either side of a dielectric layer.

* * * * *